US006210122B1

(12) United States Patent
Brøndbo

(10) Patent No.: US 6,210,122 B1
(45) Date of Patent: Apr. 3, 2001

(54) METHOD AND DELIVERING AN EXPLOSIVE COMPOSITION

(75) Inventor: Oddvar Brøndbo, Sætre (NO)

(73) Assignee: Dyno Industrier ASA, Oslo (NO)

( * ) Notice: Subject to any disclaimer, the term of this patent is extended or adjusted under 35 U.S.C. 154(b) by 0 days.

(21) Appl. No.: 09/254,469

(22) PCT Filed: Sep. 5, 1997

(86) PCT No.: PCT/NO97/00238

§ 371 Date: Jun. 4, 1999

§ 102(e) Date: Jun. 4, 1999

(87) PCT Pub. No.: WO98/10237

PCT Pub. Date: Mar. 12, 1998

(30) Foreign Application Priority Data

Sep. 6, 1996 (NO) ..... 963750

(51) Int. Cl.[7] ..... F42B 3/00

(52) U.S. Cl. ..... 417/55; 417/65; 417/100; 86/20.15; 102/313

(58) Field of Search ..... 417/55, 65, 92, 417/104, 900; 86/20.15; 102/313

(56) References Cited

U.S. PATENT DOCUMENTS

| | | | | |
|---|---|---|---|---|
| 3,749,522 | * | 7/1973 | Kazama et al. | 417/92 |
| 4,036,099 | * | 7/1977 | French | 86/20.15 |
| 4,378,183 | * | 3/1983 | Ackerman | 417/55 |
| 4,543,044 | * | 9/1985 | Simmons | 417/900 |
| 5,686,685 | * | 11/1997 | McDonald et al. | 86/20.15 |

FOREIGN PATENT DOCUMENTS

| | | | | |
|---|---|---|---|---|
| 1 242 132 | | 6/1967 | (DE) . | |
| 2339601 | * | 8/1973 | (DE) | 86/20.15 |
| 24 30 632 | | 1/1976 | (DE) . | |
| 612 971 | | 8/1994 | (EP) . | |

* cited by examiner

*Primary Examiner*—Charles G. Freay
*Assistant Examiner*—Cheryl J. Tyler
(74) *Attorney, Agent, or Firm*—Wenderoth, Lind & Ponack, L.L.P.

(57) ABSTRACT

An explosive slurry is positioned in the interior of a pressure tank. A liquid is introduced into the interior of the pressure tank and into direct contact with the slurry. The slurry is forced out of the interior of the pressure tank to a position of utilization by the pressure of the liquid and without passing the slurry through a pump.

8 Claims, 2 Drawing Sheets

METHOD AND DELIVERING AN EXPLOSIVE COMPOSITION

Figure 1:
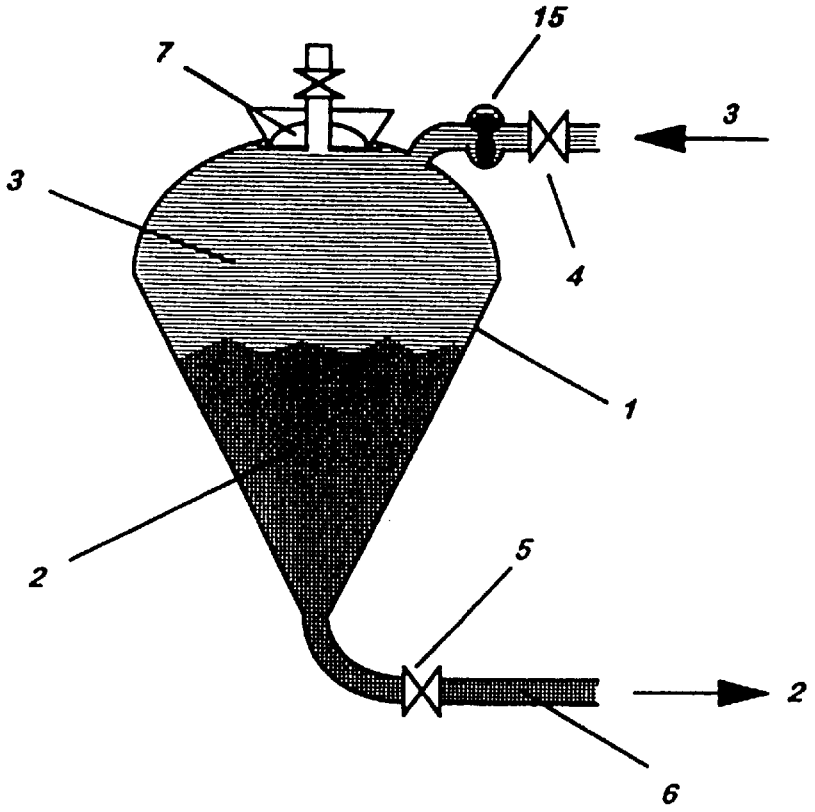

The invention refers to an arrangement for pumping, charging and cartridging of slurry, as stated in the introduction of the independent claim 1.

Ammoniumnitrate/fuel oil-explosives, here after called ANFO, have to-day a dominant position in the world's total consumption of commercial explosives. The basis for ANFO consists of only two components, ammoniumnitrate and fuel oil as the combustible component. The ANFO has excellent flow qualities, i.e. it flows easily in pipelines, it seldom builds bridges in containers, and therefore is specially well suited for bulk loading with various types of mechanical loading equipment.

Pneumatic charging is the most common way of loading ANFO in a borehole. ANFO is filled in a pressure vessel, usually described as a "pressure pot", and compressed air with a pressure of 2–6 bar is applied. ANFO is blown into the boreholes by means of a valve in the bottom of the pressure pot that opens and closes. Such pressure pots are present in relatively large numbers among the various users.

Especially in underground operations there are several disadvantages by blowing ANFO from a pressure pot. First of all, ANFO is not water resistant, and therefore the explosives capacity will be considerably reduced if there should be too much water in the boreholes. Secondly, ANFO gives away fumes when blasted, which is not in compliance with the strict demands for the air quality in an underground operation. This means that one has to ventilate the tunnel or pit before unloading. Thirdly, it may easily result in mess and waste of ANFO when pneumatic charging is applied. This again may often result in higher nitrate contents in the waste water from the tunnel or pit than allowed by the authorities. Further more, one may not have sufficient control with the quantity filled in each hole. Consequently, if the loading process should be performed by an unexperienced crew, this could lead to overloading of boreholes, resulting in stone squirt and damage. Besides, ANFO explosives could easily start dust explosions and fire when applied in a pyrite ore mine.

All these disadvantages will be reduced or eliminated by using so called emulsion explosives. Today these are loaded by pumping, which is a process where unskilled users represent an explosives hazard. Pneumatic loading is therefore a safer loading method, because the explosives will not be submitted to strain from a pump. Because pneumatic loading equipment for ANFO already is at hand among the various users, it is very favourable to use this for loading of emulsion explosives without extensive modifications.

Hereafter, emulsion explosives and so called watergel explosives, both water resistant explosives, will be mentioned as slurry explosives or just slurries.

Experiments have been carried out, filling a ready sensitized emulsion explosive directly into an ANFO pressure pot, and by means of compressed air forcing the emulsion out as by loading of ANFO. This gives the advantages of the favourable blasting techniques related to emulsion explosives compared to ANFO, but in respect of loading technique the method is not so applicable, mainly because one has no control with loaded quantity in each borehole, and also because one easily gets splash and waste when the container runs empty. Air under high pressure will then be released from the loading hose, and splash, waste and damage may easily occur.

In the present invention the ANFO pressure pots can be utilized which already exist in large numbers among the consumers, without considerable modifications, for loading of slurry. It is, of course, not necessary to use these pressure pots, since any pressure tank is covered by the present invention.

The invention also refers to any water resistant slurry, both water gel and emulsion slurry.

Today, the most hazardous step one execute when slurries are being loaded, is the fact that the slurry has to pass through a pump being exposed to considerably strain. Quite a number of the serious accidents world wide in connection with slurries have been caused of slurry pumps.

One advantage of the present invention is the fact that the slurry is not treated in a pump.

According to the invention an arrangement is applied for pumping, loading and cartridging of a slurry as stated by the characterizing features of claim 1.

In the present invention a liquid (which is incompressible) is applied to press (force) the slurry out of the container. The advantage as mentioned before is that the slurry is not subjected to any strain in a pump, and besides gaining all the other benefits the slurries have compared to ANFO, it is possible to apply existing "pressure pot" for ANFO only with minor modifications, if so should be desirable.

The most preferred displacement liquid is water, because water is easily accessible, harmless, easy to pump and dose, and have no environmental restrictions regarding spillage.

The device according to the invention is applicable not only for explosives mixtures, but also for other sensitive products which may be both difficult and risky to pump.

Figure 2:
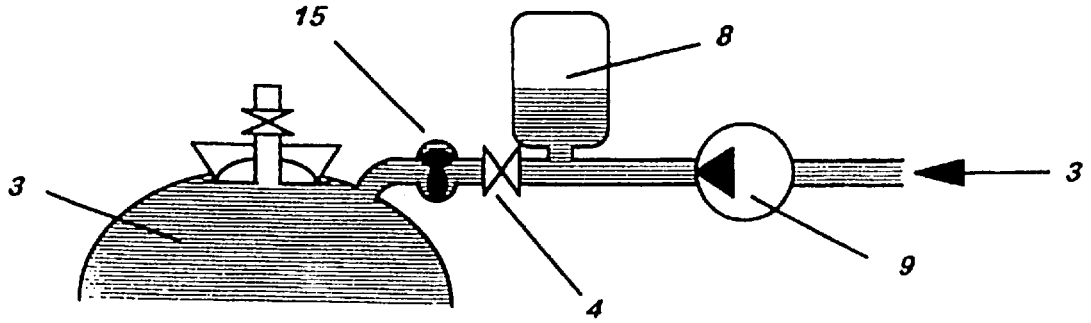
Figure 3:
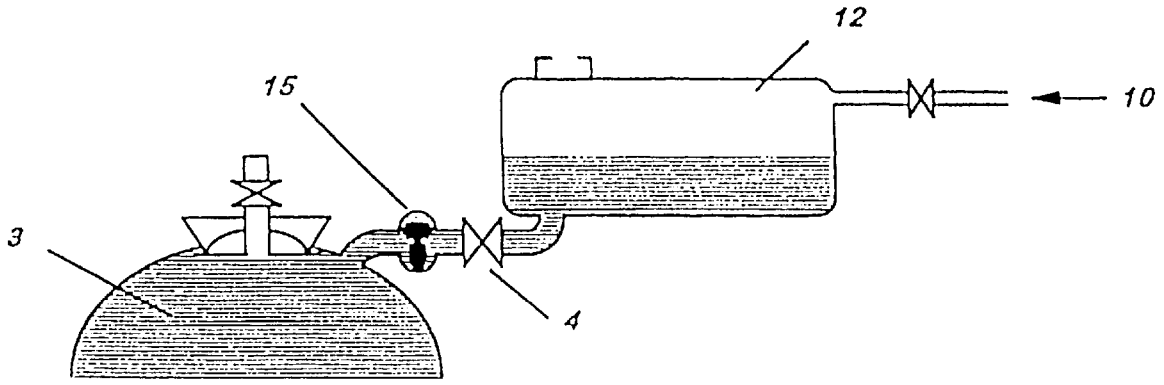

There are several ways of practising the present invention, and the invention will in the following be described through one embodiment with reference to the attached drawings where:

FIG. 1 shows a first embodiment of the device according to the present invention, and, FIGS. 2 and 3 show equipment which can be applied in connection with the embodiment of FIG. 1.

In FIG. 1 an embodiment of the invention is shown wherein a fluid 3 is in direct contact with slurry-explosives 2. This fluid 3 can be water or water with addition of an anti-freeze agent, for instance glycol or different nitrates. When the slurry-explosives 2 shall be loaded, a valve 4 will be opened which via a meter 15 doses a fixed quantity of fluid 3 into the pressure tank 1, when occluded air has been removed beforehand through a valve 7, which may be placed in the filling cap or in another high standing point at the tank 1. The fluid 3 is forced into the tank either by help of a pump, or if the fluid should be water, this can be lead directly from the water pipe. When a fixed volume of fluid 3 is let into the pressure tank, this will displace an identical volume slurry 2 out of the loading hose 6. When the control valve 4 is shut, the flow of slurry will also stop. It is not necessary to use valve 5 in the outlet of the pressure tank 1, but it may be used if so should be desired. In this way, the slurry is neither exposed to forces/stress from the pump, nor from a possible valve which opens and closes.

In FIGS. 2 and 3 details are shown which can be used in connection with the embodiment described in FIG. 1. In FIG. 2 there is placed a pressure balancing chamber 8 which provides for that pump 9 does not have to start and stop all the time, but only runs when the pressure in the pressure balancing chamber 8 falls under a certain level. In FIG. 3 the pressure is created which forces the fluid 3 into the pressure tank 1 of compressed air 10, which leads into a pressure reservoir 12 where the compressed air creates a pressure on the displacement liquid 3.

In the embodiment of the invention it is possible to use one or more loading hoses 6 simultaneously.

What is claimed is:

1. A method for delivering an explosive slurry to a position of utilization, said method comprising:

placing said slurry in an interior of a pressure tank; and introducing a liquid into said interior of said pressure tank and into direct contact with said slurry, and forcing said slurry out of said interior of said pressure tank to said position of utilization, by a pressure of said liquid and without passing said slurry through a pump.

2. A method as claimed in claim 1, wherein said liquid comprises water.

3. A method as claimed in claim 1, wherein said liquid includes therein at least one antifreeze agent.

4. A method as claimed in claim 1, wherein said placing comprises positioning said slurry to fill a bottom of said interior of said pressure tank.

5. A method as claimed in claim 1, wherein said introducing comprises directing said liquid into direct contact with a top level of said slurry in said interior of said tank.

6. A method as claimed in claim 1, wherein said introducing comprises positioning said liquid in a pressure balancing chamber before said liquid is passed to said interior of said tank.

7. A method as claimed in claim 6, wherein said liquid passes from said pressure balancing chamber to said interior of said pressure tank without passing through a pump therebetween.

8. A method as claimed in claim 1, wherein said position of utilization comprises a borehole.

* * * * *